US006196599B1

(12) United States Patent
D'Hooge

(10) Patent No.: US 6,196,599 B1
(45) Date of Patent: Mar. 6, 2001

(54) PUSH/PULL DOOR LATCH

(75) Inventor: Richard D'Hooge, Wooddale, IL (US)

(73) Assignee: Architectural Builders Hardware Manufacturing Inc., IL (US)

( * ) Notice: Subject to any disclaimer, the term of this patent is extended or adjusted under 35 U.S.C. 154(b) by 0 days.

(21) Appl. No.: 09/348,127

(22) Filed: Jul. 2, 1999

Related U.S. Application Data

(63) Continuation of application No. 08/574,380, filed on Dec. 18, 1995, now abandoned.

(51) Int. Cl.[7] ..... E05C 1/12

(52) U.S. Cl. ..... 292/165; 292/336.3

(58) Field of Search ..... 292/165, 173, 292/92, 336.3, 166–168

(56) References Cited

U.S. PATENT DOCUMENTS

| | | | | |
|---|---|---|---|---|
| 2,108,359 | * | 2/1938 | Accardi | 292/165 |
| 2,228,979 | * | 1/1941 | Schrader | 292/173 |
| 2,287,446 | * | 6/1942 | Parsons | 292/167 |
| 3,698,215 | * | 10/1972 | Truhon | 292/173 |
| 4,003,593 | * | 1/1977 | Wilzig | 292/165 |
| 4,007,954 | * | 2/1977 | Erickson | 292/165 |
| 4,629,228 | * | 12/1986 | Marko | 292/165 |
| 4,986,583 | * | 1/1991 | Campbell | 292/336.3 |
| 5,609,372 | * | 3/1997 | Ponelle | 292/200 |

* cited by examiner

*Primary Examiner*—B. Dayoan
*Assistant Examiner*—Gary Estremsky
(74) *Attorney, Agent, or Firm*—Patnaude & Videbeck

(57) ABSTRACT

A push/pull door latch is disclosed with pivotal handles, both having a foot portion for operating respective eccentric portions of a crank-shaped actuator to retract a latch bolt, the handles also having stop portions for contacting portions of a base member to define a range of motion of the handles.

3 Claims, 9 Drawing Sheets

PUSH/PULL DOOR LATCH

This application is a continuation of application(s) application Ser. No. 08/574,380 filed on Dec. 18, 1995, now abandoned.

The present invention relates to door latches which are opened by pushing a lever on one side of a door, or pulling a lever on the opposing side of a door whereby movement of one of the levers causes a locking bolt to be withdrawn into its housing, and in particular the invention relates to the handles therefor.

BACKGROUND OF THE INVENTION

Push/pull door latches have been found particularly suitable for use on doors to hospital rooms and the like which typically open into the room. A hospital door provided with a push/pull type latch is opened from the outside by applying pressure to the push side of the latch, and opened from the inside by pulling on the pull side of the latch. A hospital technician may enter a patient's room while carrying an armload of medical equipment by merely applying pressure to the push side of the latch, thereby unlatching the door and pushing it open. Conversely, a patient who may have limited use of his or her arms because of the presence of a cast or the like, can unlatch a door and open it from the inside by pulling on the inside handle, an effort requiring a minimum of dexterity.

A number of push/pull type latches are available, and two typical examples can be found in Toledo, U.S. Pat. No. 5,085,474, and Walls, U.S. Pat. No. 5,403,047.

Push/pull door latches include a slide bolt which is movable from an extended/latched position to a retracted/release position, and a cam which is rotatable between a first position and a second position. When the cam is in the first position, a slide bolt in the door latch is in the extended/latched position. When the cam is rotated to the second position, the slide bolt is moved to the retracted/release position. The latch further includes a lever having a central fulcrum, one end of which serves as the handle, and the opposing end of which has a threaded foot added thereto by drilling and tapping that end. The foot is positioned against the cam. The handle is movable from a first position in which the cam is in its first position, and the slide bolt is extended, to a second position thereby rotating the cam to its second position, and retracting the slide bolt.

The handles for such push/pull type door latches are typically cast metal and require stops to prevent the rotation of the handle through a greater arc than that bounded by the first and second positions. Existing castings for handles must be drilled and machined to receive the stops. Such stops are in the form of pins and are identified by indicia number 38 in the patent to Walls, and are not shown in the patent to Toledo. A study of the specification and FIG. 1 of Toledo, however, reveals that the left handle 18 is free to rotate clockwise, and the right handle 18 is free to rotate counterclockwise unless such movement is prevented by a stop. Handles constructed in accordance with Toledo must also be drilled and machined to receive the stops.

To simplify the construction of such a push/pull type door latch, it would be desirable to provide a handle and a handle mounting assembly for a push/pull handle which would not require that the cast metal handle be machined to receive such stops. Specifically, it would be most desirable to provide a handle for a push/pull door latch which would not require the insertion of stops in the handle as a step towards the assembly of a door latch.

SUMMARY OF THE INVENTION

Briefly, the present invention is embodied in a push/pull latch for use on a door having a planar surface. The latch has a slide bolt which is movable from a first extended/latched position to a second retracted/release position, and a cam which is rotatable about an axis perpendicular to the surface of the door. The cam is rotatable from a first position in which the slide is in the extended/latched position to a second position in which the slide bolt is in the retracted/release position. The latch further has a first spring for urging the bolt from the second position to the first position such that the bolt is in the first position unless it is retracted by a force, such as is applied by the cam, to the second position.

In accordance with the present invention, a unitary base plate has a mounting portion and opposing side panels, with the mounting portion positioned against the surface of the door. The cam is mounted on a shaft perpendicular to the surface of the door and the shaft extends through the mounting portion of the base plate. To rotate the cam to the second position, a second cam is mounted on the end of the shaft which extends through the base plate, and the second cam is engaged by one end, or foot, of a lever arm. The lever arm has a central fulcrum which is pivotally mounted between the opposing panels of the unitary base plate, and the opposite end of the lever arm is a handle which is pushed or pulled to force the foot against the second cat to retract the bolt. The lever arm is movable from a first position to a second position thereby causing the foot to move the cam from its first position to its second position, and a second spring urges the lever arm from its second position, wherein the bolt is retracted, to its first position, wherein the bolt is extended. In accordance with the present invention, the lever arm is made of a unitary piece of material and includes a first stop for contacting the base plate when the lever arm is in its first position to prevent movement of the foot away from the cam when the cam is in its first position.

The lever arm also includes a second stop cast therein which will contact the base plate when the lever arm is in the second position to prevent further rotation of the lever after the cam has reached its second position.

GENERAL DESCRIPTION OF THE DRAWINGS

Further objects and advantages and a better understanding of the present invention will be had by reference to the following detailed description taken in conjunction with the accompanying drawings wherein.

FIG. 12*a* is a diagramatic view of the latch of the invention shown with both latch handles extending upwardly;

FIG. 12*b* is a diagramatic view of the latch of the invention shown with both latch handles extending downwardly;

FIG. 12*c* is a diagramatic view of the latch of the invention shown with one handle extending downwardly and the opposing handle extending upwardly;

FIG. 12*d* is a diagramatic view of the latch shown with the latch handle extending horizontally to the left;

FIG. 12*e* is a diagramatic view of the latch shown with the latch handle extending horizontally to the right.

DETAILED DESCRIPTION OF THE PREFERRED EMBODIMENT

Figure 1:
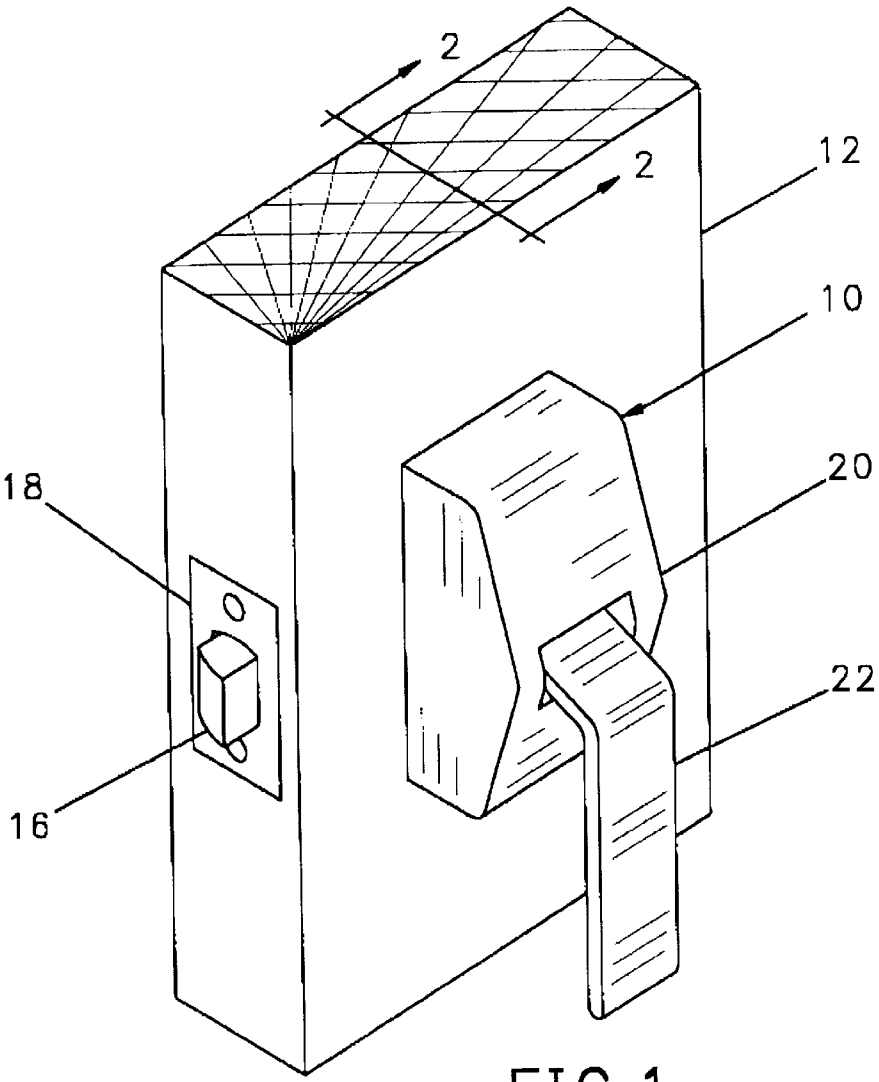
FIG. 1 is an isometric view of a portion of a door having a push/pull door latch constructed in accordance with the present invention attached thereto.

Referring to FIG. 1, a push/pull type door latch 10 is assembled on a door 12 having a planar surface 14. The latch includes a slide bolt 16 which is longitudinally slidable within an assembly, the outer face plate 18 of which is visible. The slide bolt 16 is depicted as being in its extended/latched position in which the distal end of the bolt 16 extends outward from the surface of the face plate 18. When the door 12 is closed against a door frame having a strike plate, not shown, with an aperture therein to receive the extended slide bolt 16, the door will be latched.

Figure 2:
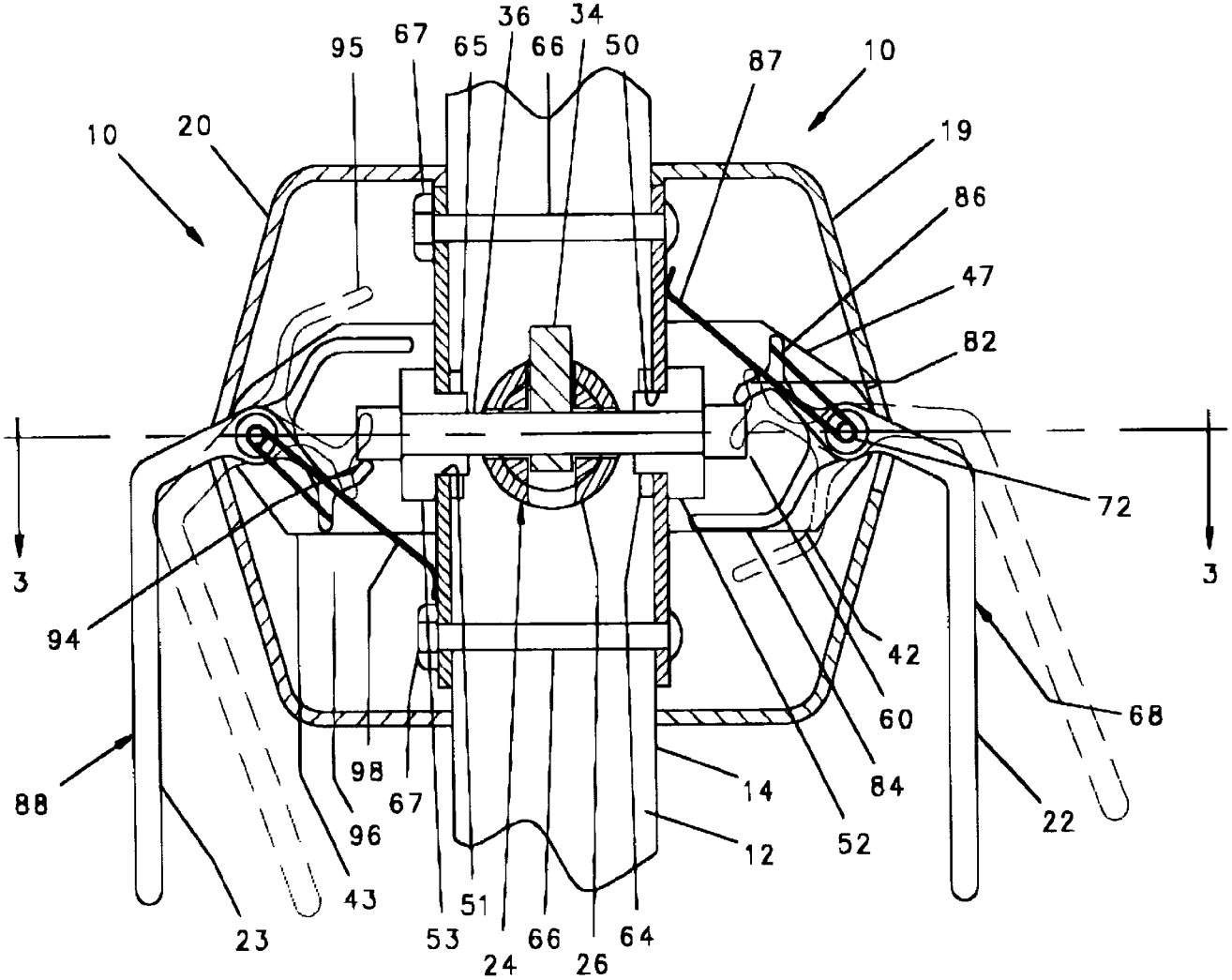
FIG. 2 is a cross-sectional view of the door and door latch of FIG. 1 taken through line 2—2 of FIG. 1.

Referring to FIG. 2, the door latch 10 has cover plates 19, 20 positioned on each side of the door 12. Extending from the cover plates 19, 20 are movable handles 22, 23, respectively. The bolt 16 is retracted and the latch 10 is released by applying a push force against handle 23 or by applying a pull force against handle 22.

Figure 3:
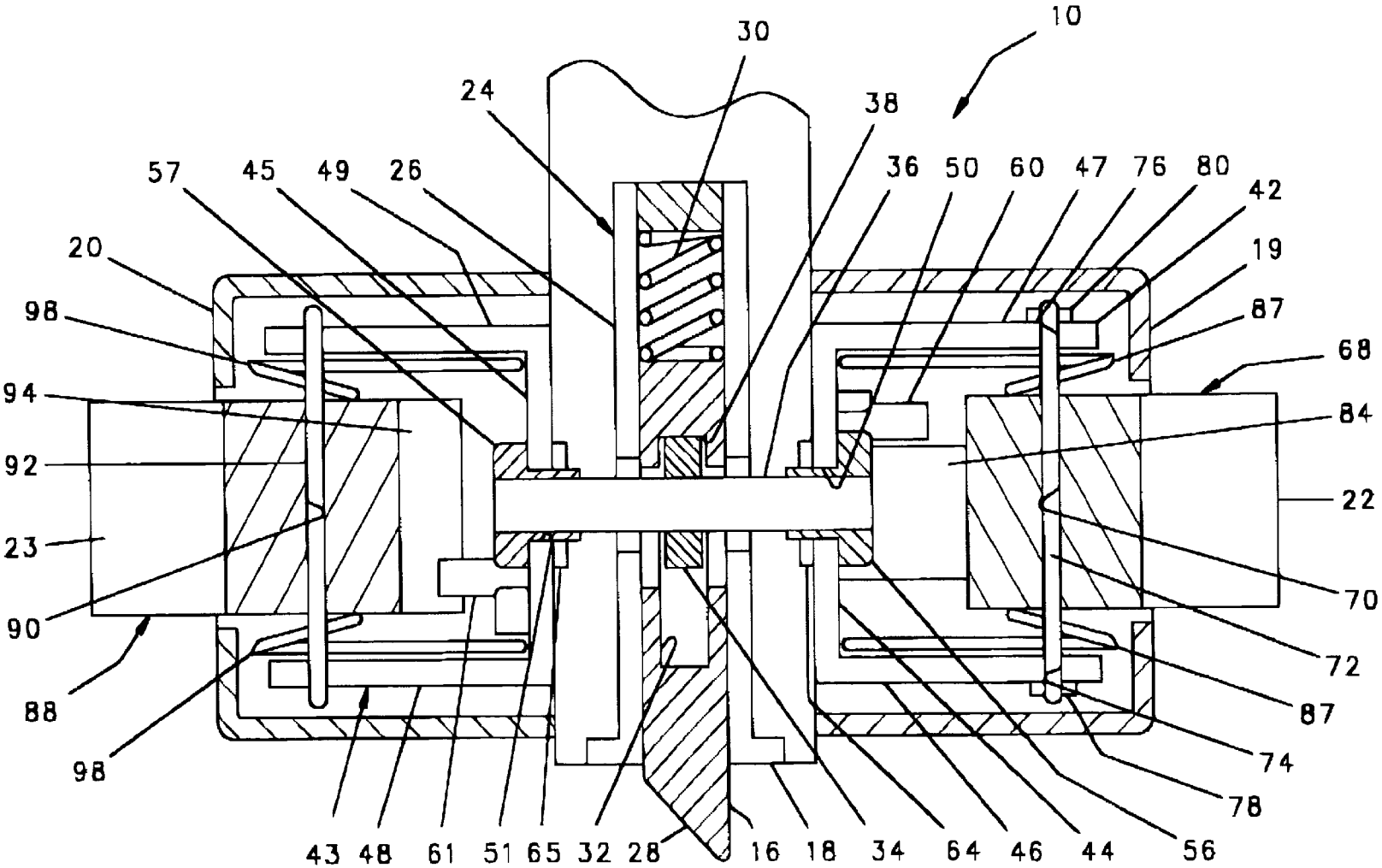
FIG. 3 is a cross-sectional view of the door latch shown in FIG. 1 taken through line 3—3 of FIG. 2.

Referring to FIGS. 2 and 3, the slide bolt assembly 24 is of the type commonly known in the art and is depicted herein with a minimum of detail. The assembly includes a tubular housing 26 which slidably receives the bolt 16 and has an angular outer end 28 which strikes the edge of a strike plate, not shown, to force the bolt 16 into the tubular housing 26. The assembly 24 further includes a spring 30, which urges the bolt 16 to an extended position, and a stop, not shown, which prevents movement of the bolt beyond the extended position. Centrally located within the bolt 16 is an elongate slot 32 for receiving a bolt cam 34 fitted on an elongate key 36 having a square cross section. The rear surface 38 of the slot 32 is positioned such that rotation of the crest 40 of the cam 34 against the rear surface 38 forces the bolt 16 into a retracted position in which the outer end substantially in the plane of the outer surface of the face plate 18, as shown in phantom lines in FIG. 3.

As shown in FIGS. 2, 3, 5 and 6, against each of the surfaces 14 of the door 12 are base plates 42, 43 having planar mounting portions 44, 45 fitted against the surfaces 14 of the door 12, and extending from opposing edges of the mounting portion 44 are opposing upstanding side panels 46, 47 and extending from opposing edges of the mounting portion 45 are opposing upstanding side panels 48, 49.

Centrally located in the mounting portion 44 is a circular aperture 50 through which one of the distal ends of the key 36 extends. Similarly, centrally located in mounting portion 45 is a circular aperture 51 through which the opposing end of the key 36 extends. Cam assemblies 52, 53 are fit over one each of the distal ends of the key 36.

Figure 4:
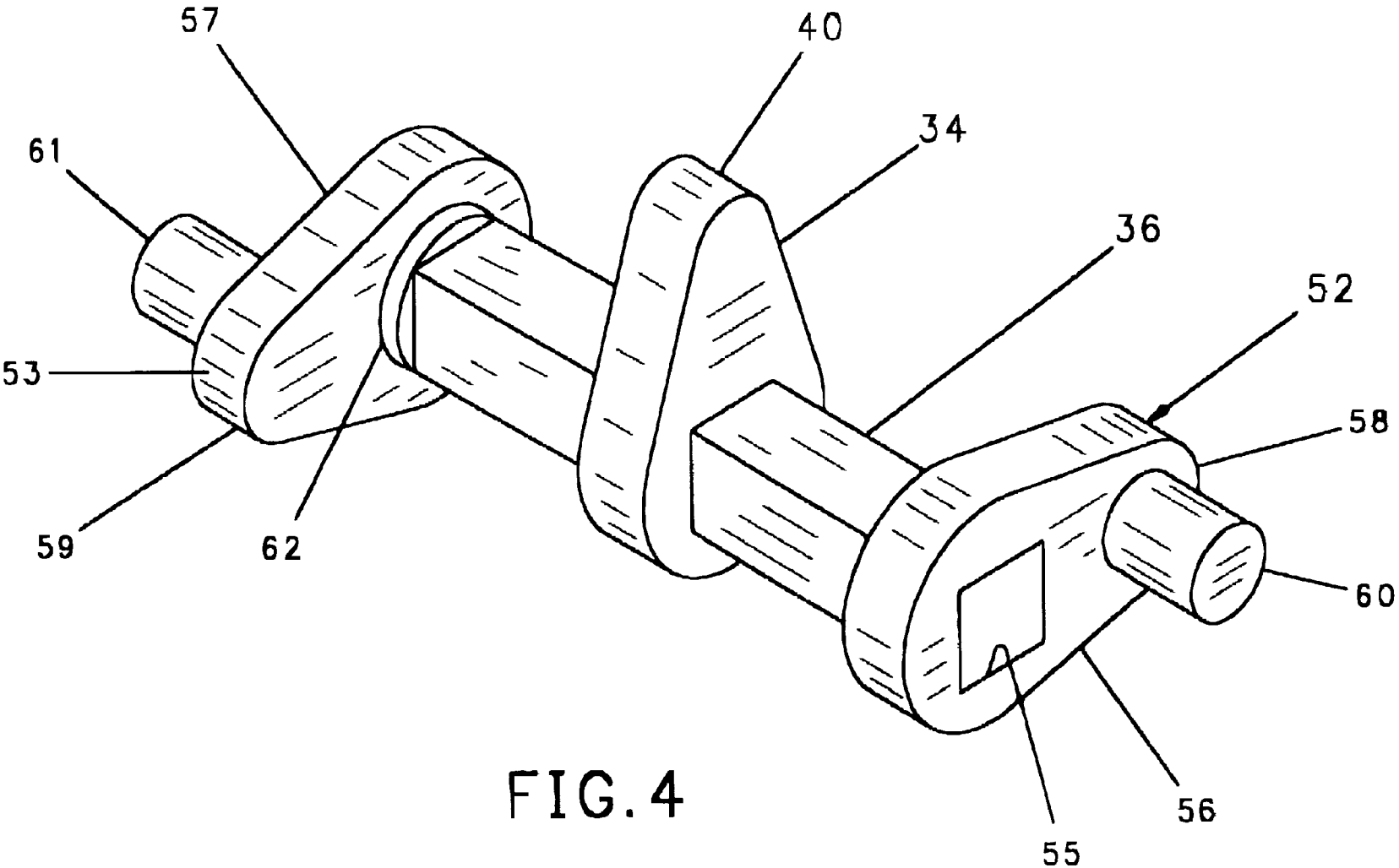
FIG. 4 is a perspective view of a cam and key assembly for use in the push/pull latch of FIG. 1.

Referring to FIG. 4, in which the key 36, the bolt cam 34, and the cam assemblies 52, 53, are depicted, each cam assembly 52, 53 includes a cam 56, 57, respectively, which has a square aperture 55 therein for slidably receiving the distal end of the key 36. Each of the cams 56, 57 has an extension 58, 59, respectively, and extending from the outward surface of each of the extensions parallel to the axis of the key 36, are cylindrical posts 60, 61, respectively, which extend from the sides of the cam member 52, 53. Extending from the opposing surface of each cam member 52, 53 is a cylindrical sleeve, one of which 62 is visible. The sleeves 62 fit slidably within the centrally located apertures 50, 51 of the mounting portions 44, 45 of the base plate 42, 43 and are retained therein by retaining rings 64, 65 on the opposite side of each plate.

As can be seen, the cams 56, 57 are positioned on the key 36 such that the extensions, 58, 59 and cylindrical posts 60, 61 are 180 degrees apart from one another about the axis of the key 36. Also, the crest 40 of bolt cam 34 is 90 degrees from the angular position of either post 60 or post 61. The assembly of cams 34, 56 and 57, as depicted, in FIG. 4 is in the orientation of the assembly of cams within the latch 10 while the bolt 16 is extended as shown in FIG. 1. The rotation of the key 36 and bolt cam 34 in the clockwise direction, as viewed in FIG. 4, will force the crest 40 of cam 34 against the rear surface 38 of bolt 16 and retract the bolt 16. The rotation of the key 36 and bolt cam 34 retract the bolt 16 and is accomplished by applying either an upward force to pin 61 or a downward force to pin 60.

Figure 5:
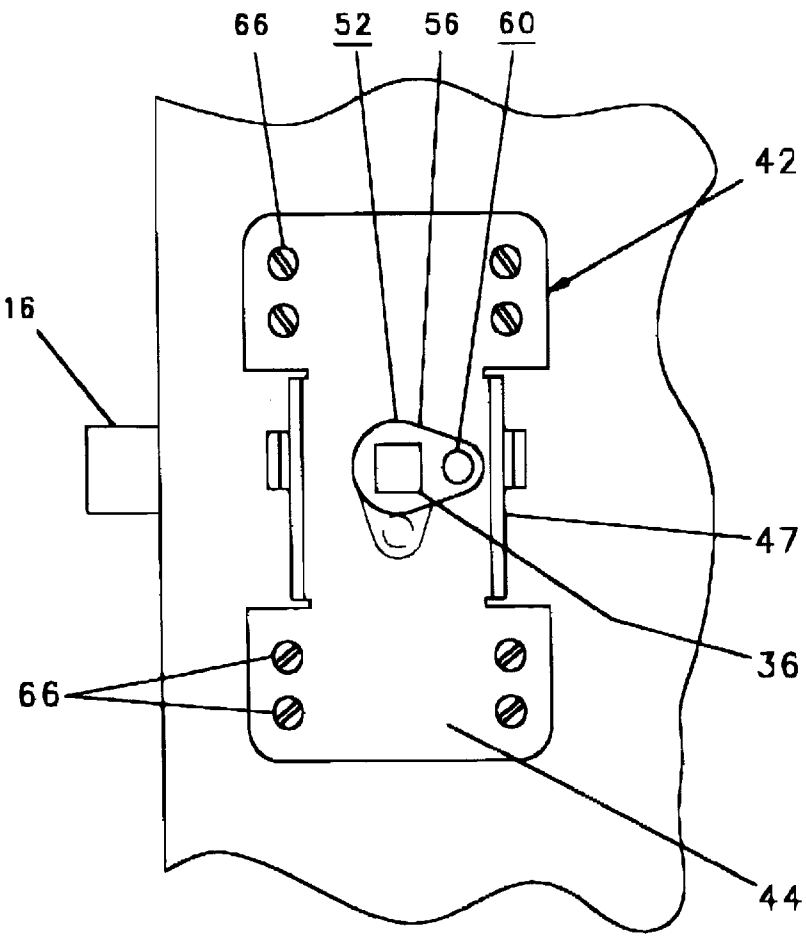
FIG. 5 is a front view of the base plate on the right side of FIG. 3 and the cam for the latch shown in FIG. 1 prior to attachment of the handle thereto.

Referring to FIG. 5 the surface 14 of the door 12 is depicted with the base plate 42 attached thereto by a plurality of screws 66—66. Cam assembly 52 is shown in solid lines in its first position with the post 60 positioned to the right of the key 36. When the cam assembly 52 is positioned as shown in solid lines, the crest 40 of the bolt cam 34 is not against the rear surface 38 of the slot and the bolt 16 is in the extended/latched position. When the cam assembly 52 is rotated 90 degrees clockwise to the second position shown in phantom lines, the crest 40 of bolt cam 34 will rotate against the surface 38 and the slide bolt 16 will be withdrawn to the retracted/release position.

Figure 6:
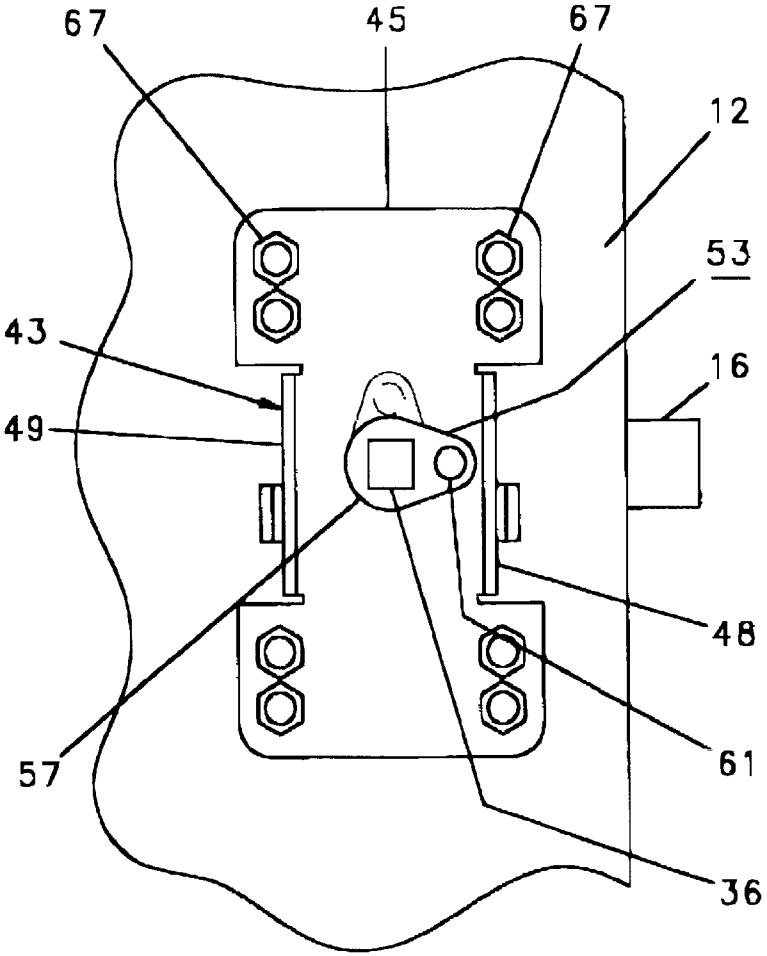
FIG. 6 is a front view of the base plate on the left side of FIG. 3 and the cam for the latch shown in FIG. 1.

Referring to FIG. 6 in which the base plate 43 on the opposite side of the door 12 and the second cam assembly 53 are shown, the base plate 43 is retained by a plurality of nuts 67—67 tightened on the screws 66—66 extending from the first plate 42. The cam 53 is depicted in solid lines with the post 61 to the right of the key 36, and the slide bolt 16 in the extended/latched position. To retract the slide bolt 16, the cam assembly 53 is rotated 90 degrees counterclockwise to a second position shown in phantom lines causing the crest 40 of bolt cam 34 to be forced against surface 38.

Referring to FIG. 2, the left handle 23 is a push handle which can be pushed from its first position shown in solid lines in which the slide bolt is in the extended/latch position to its second position shown in phantom lines, in which the slide bolt is in the retracted/release position. Conversely, handle 22 on the right side of the door is a pull handle and may be pulled from its first position shown in solid lines in which the slide bolt 16 is in the extended/latched. position, to its second position, shown in phantom lines, in which the slide bolt 16 is in the retracted/release position.

Figure 8:
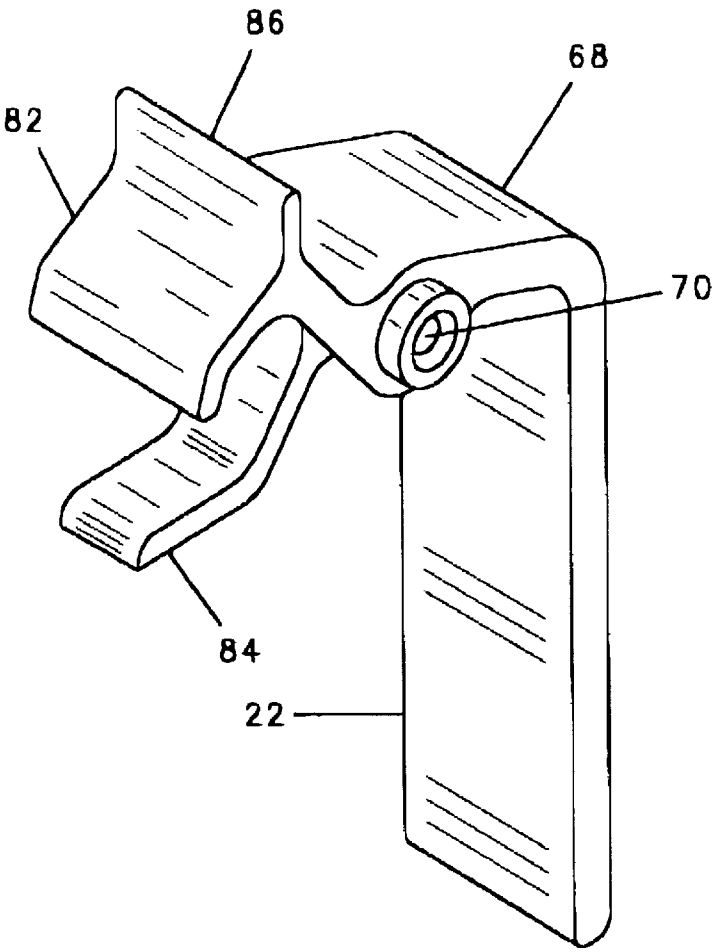
FIG. 8 is an isometric view of the handle shown on the right side of the latch as seen in FIG. 3.

Referring to FIGS. 2, 5 and 8, the handle 22 is one end of a lever arm 68 having a centrally located transverse hole 70 through which is positioned a pivot pin 72, the outer ends of which are fitted through apertures 74, 76 in the opposing side panels 46, 47 of the base plate 42, and the pin 72 serves as a fulcrum about which the lever arm 68 moves. Retaining clips 78, 80 upon each of the distal ends of the pin 72 retain the pin 72 between the two side panels 46, 47.

As best shown in FIGS. 2 and 8, the lever arm 68 has a hooked elongate foot 82 which is adapted to fit against the pin 60 of the cam assembly 52 and also has a stop arm 84. The stop arm 84 is an elongate projection on the lever arm 68, the distal end of which is adapted to abut against the outer surface of the mounting portion 44 of the base plate 42 when the lever arm 68 and handle 22 are in the first position shown in solid lines. When the handle 22 is in the first position, shown in solid lines, the arm stop 84 will prevent movement of the lower end of the handle 22 toward the door 12. Movement of the handle 22 from the position shown in solid lines to the position shown in phantom lines in FIG. 2 will cause the foot 82 to move downwardly against the post 60 in a plane substantially normal to and spatially related to a parallel plane including the pivot pin 72 and rotate the cam assembly 52 to the second position shown in phantom lines in FIG. 2, thereby causing the slide bolt 16 to move to the retracted/release position. When the handle 22 is moved to the second position, it cannot move any farther as the cam is at the bottom of its rotation. Flange 86 provides a secure surface for mounting spring 87 to bias the lever arm 68 in its first position.

A spring 87 has a central portion which extends across the width of the lever arm 68 at flange 86, and the two outer portions of the spring 87 wrap around opposite end of the pin 72, with the distal ends thereof positioned against the surface of the mounting portion 44 of the plate 42. The spring 87 is adapted to urge the lever arm 68 to rotate clockwise, as seen in FIG. 2, thereby urging the handle 22 from the second position shown in phantom lines to the first position shown in solid lines.

Figure 7:
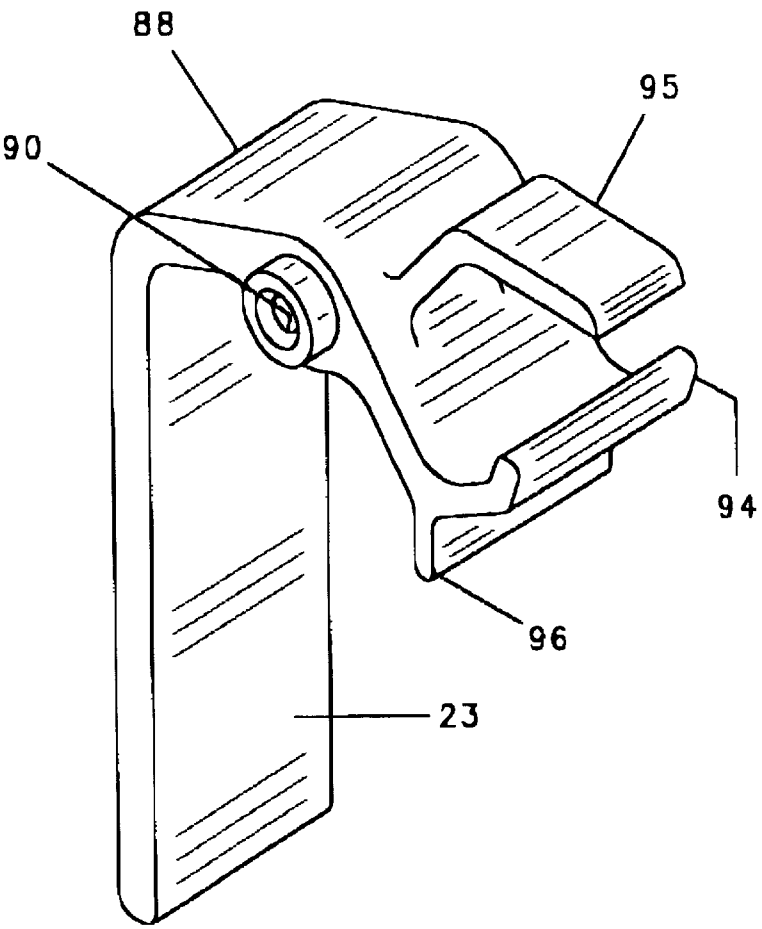
FIG. 7 is an isometric view of the handle shown on the left side of the latch as seen in FIG. 3.

Referring to FIGS. 2, 6 and 7, the handle 23 is a lever arm 88 similar to the lever arm 68 on the opposing side of the door. Like the lever arm 68, lever arm 88 has a centrally located transverse aperture 90 through which a pin 92 is fitted and the distal ends are retained in apertures in the opposing side panels 48, 49 such that the pin 90 serves as the fulcrum of the lever arm 88. The end of the lever arm 88 which is opposing to the handle 23 also has a foot 94 which engages the post 61 of the cam assembly 53 and moves the post 61 in a plane which is substantially normal to and spatially related to a parallel plane including pivot pin 92. As best shown in FIGS. 2 and 8, the lever arm 88 includes a stop arm 95 which contacts the mounting portion 45 of the base plate 43 when the handle 23 is in the first position shown in solid lines so as to prevent further movement of the end of the handle 23 away from the door. A flange 96 on the lever arm 88 provides a secure surface for mounting the spring 98 to bias the lever arm 88 in its first position. When the handle 23 is moved to the second position shown in phantom lines, it cannot move any farther as the cam is at the top of its rotation. Spring 98 urges the lever arm 88 to rotate clockwise as seen in FIG. 2. The lever arms 68, 88 which form the handles 22, 23, respectively, are each made of a single unitary piece, and in the preferred embodiments are made of cast metal. When made in this fashion, the foot 82 and stop 84 of lever arm 68 and the foot 94 and stop 95 of lever arm 88 are all cast integrally with the lever arm. Therefore, the assembly is constructed with a minimum of machining.

Figure 9:
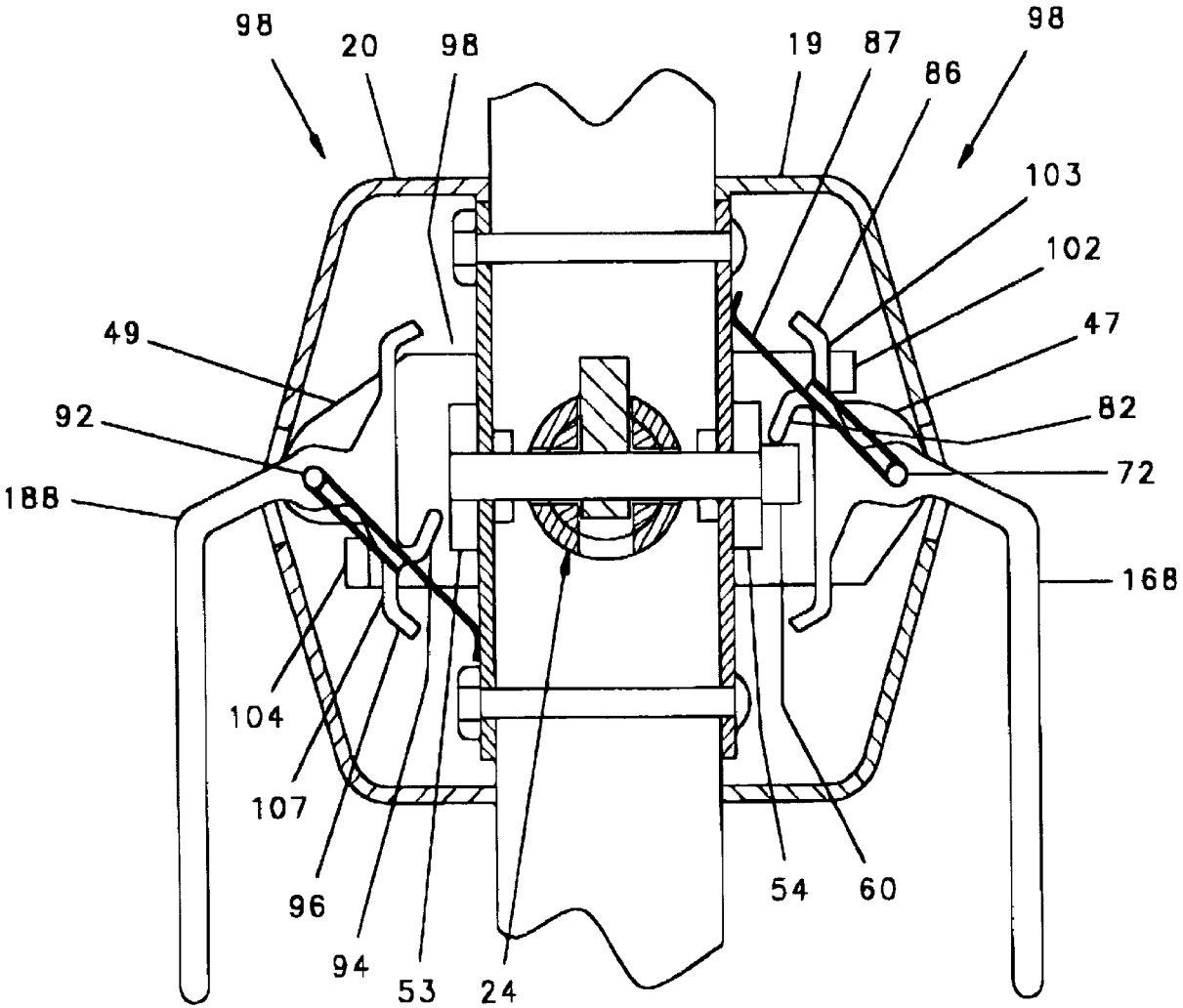
FIG. 9 is a cross-sectional view of a second embodiment of the push/pull latch assembly of the present invention.
Figure 11:
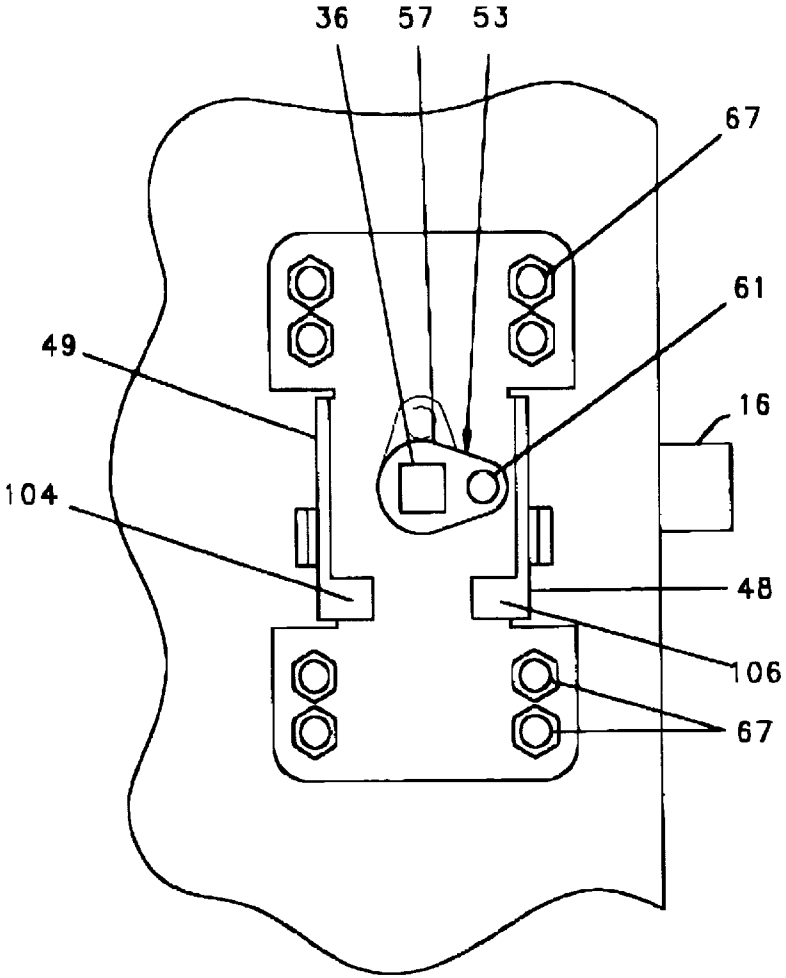
FIG. 11 is a front view of the left base plate for receiving a handle for the embodiment shown in FIG. 9.
Figure 10:
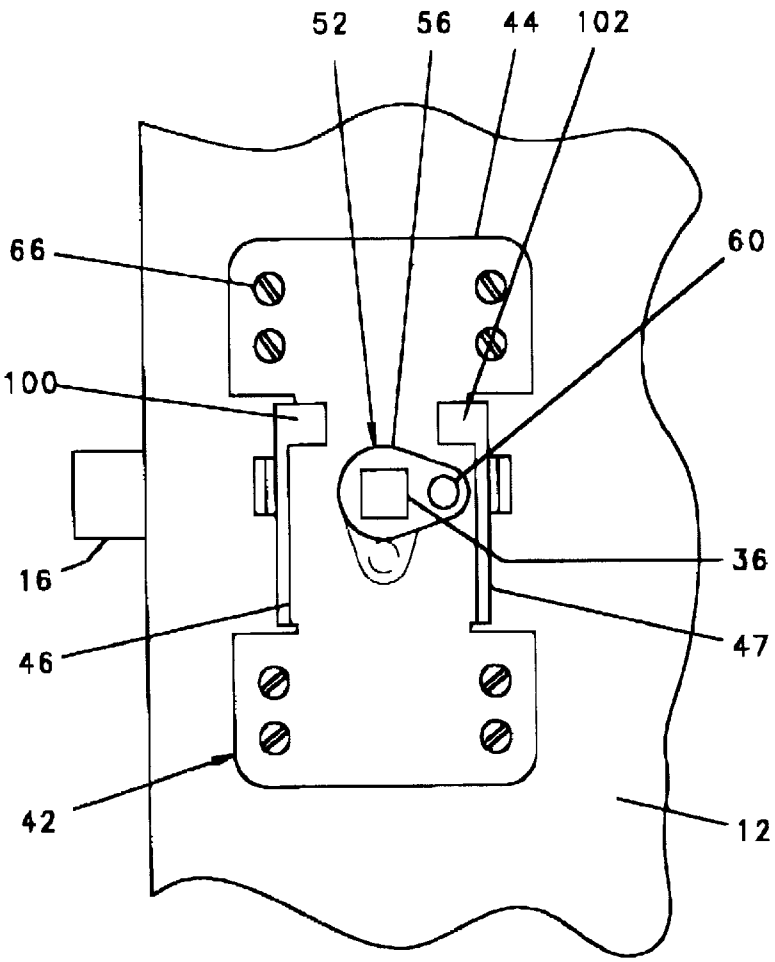
FIG. 10 is a front view of the right base plate for receiving a handle for the embodiment shown in FIG. 9.

A second embodiment 99 of the present invention is depicted in FIGS. 9, 10 and 11, with part identifying numbers being generally 100 higher than like parts shown in the first embodiment. In this embodiment, the first lever arm 68 is not provided with a stop arm such as 84 in the first embodiment and, similarly, the second lever arm 188 is not provided with a stop arm such as 95 in the first embodiment. The stop arm 84 of the first lever arm 68 was intended to prevent the handle 22 from being withdrawn away from the door beyond the position shown in solid lines in FIG. 2 which would also cause the foot 82 to be withdrawn from the post 60. In the second embodiment, the base plate 142 has a pair of opposing tabs 100, 102 which extend towards each other from the inner surfaces of the opposing side panels 146, 147. The inner surfaces of the tabs 100, 102 contact an outer surface 103 of the lever arm 168 when the lever arm is in the position shown in solid lines in FIG. 9, thereby providing a stop. Similarly, a pair of inwardly extending tabs 104, 106 on each of the opposing side panels 144, 146 of the opposing base plate 143 serve as stops against an outer surface 107 of the portion of the second lever arm 188. The outer surface 107 of the second lever arm 188 contacts the inner surface of the tab 104, 106 when the lever arm 188 is in the first position shown in solid lines, and thereby prevents withdrawing of the lever arm 188 and handle away from the door.

Figure 12:
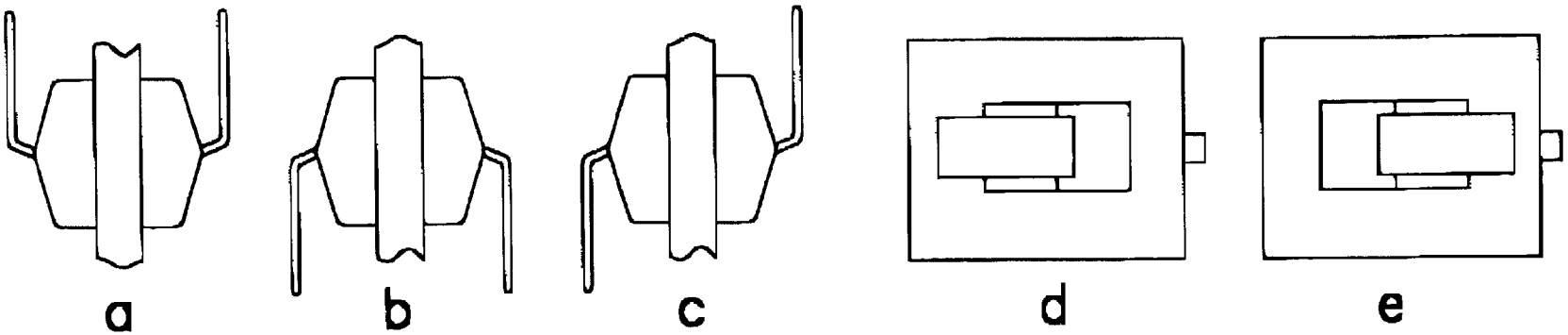

Referring to FIG. 12, by varying the latches and changing the positioning of the base plates on the push/pull door latch of the present invention several differing workable combinations of the assembly may be obtained. As shown in FIG. 12*a*, the push/pull latch assembly may be positioned with both lever arms pointing upward. In FIG. B both lever arms may be positioned pointing downward. FIG. C discloses a push/pull type latch with one lever arm on one side of the door facing downward and the lever arm on the opposing side of the door facing upward. Likewise, one lever arm may be positioned vertically with an opposing lever arm positioned horizontally (not shown). The lever arms in FIGS. 12*a*, 12*b* and 12*c* may either be push or pull type lever arms and may be mixed, matched, or complementary depending upon the uses intended for the door.

Referring to FIGS. 12*d* and 12*e*, in these pictures, the base plates (not shown) for the push/pull type latch have been rotated 90 degrees from that shown in FIG. 2. In a manner similar to that shown in FIGS. 12*a* and 12*b*, the latch arms may be positioned to extend either to the left as shown in FIG. 12*d* or to the right as shown in FIG. 12*e*. Similarly to FIG. 12*c* it will be understood that the latch arms may also be positioned in mixed, matched, or complementary positions on the opposing side of the door.

After describing the first and second embodiments, it should be noted that to provide for compatibility, stop arms 84 and 95, respectively, have been made narrow horizontally to allow the lever arms 68, 88 to be installed on the base plates 142, 143 of the second embodiment with the lever arms able to clear the inwardly extending tabs 100, 102, 104, 106.

As can be seen, the present invention provides for the construction of a door latch assembly having stops which prevent movement of the door handle beyond the limits required for the operation of the door latch, and that the stops are manufactured without requiring machining or tooling.

While two embodiments of the present invention have been disclosed, it will be apparent to those skilled in the art that many changes and modifications may be made without departing from the true spirit and scope of the invention. It is, therefore, the purpose of the appended claims to cover all such changes and modifications which fall within the true spirit and scope of the present invention.

What is claimed:

1. A latch assembly including a latch handle, a latch bolt, operating means for operating same, and a base plate adapted for mounting on a surface of a door, said base plate retaining said handle and said latch bolt operating means thereon, said operating means including a rotatable member having an axis perpendicular to said surface of the door when mounted thereon, said latch assembly comprising:

a unitary member including a central fulcrum for pivotally mounting said handle on a housing, an elongate arm on one side of said fulcrum and actuation/stop means on an opposing side of said fulcrum for directly actuating a means for operating a latch bolt and for preventing over rotation of said handle on its pivotal mounting, said actuation/stop means further including, an actuating foot extending from said fulcrum having a distal end engageable with said operating means;

at least one stop portion extending from said fulcrum for engaging said base plate after said actuating foot engages said operating means and defining at least one end of said range of movement of said actuating foot, a latch bolt and cam means for operating said latch bolt, said cam means being positioned for rotational movement in a plane parallel and spatially related to a plane of said latch bolt, said cam means operatively engaging said latch bolt through a connecting shaft having an eccentric centrally positioned thereon, said cam means including a substantially flat body and a foot engaging arm extending normally from said body at a position offset from said connecting shaft.

2. In a latch for mounting on a planar surface of a door, said latch having a slide bolt movable from a first extended position to a second retracted position, and a cam rotatable from a first position wherein said slide bolt is in said extended position, to a second position wherein said slide bolt is in said retracted position, said cam rotatable about an axis perpendicular to the planar surface when mounted on the door, and first biasing means for urging said bolt from said second position to said first position, the improvement comprising:

a base plate having a planar mounting portion and opposing side panels;

a lever arm pivotally mounted at its fulcrum between said opposing side panels, said lever arm having a handle end and an opposing foot for directly engaging said cam with said lever arm movable from a first position wherein said foot is in engagement with said cam while said cam is in said first position and a second position wherein said foot is in engagement with said cam while said cam is in said second position;

second biasing means urging said lever arm from said second position to said first position;

a stop on said lever, said stop contacting said planar mounting portion of said base plate when said lever arm is in said first position for preventing movement of said foot away from said cam when said cam is in said first position;

said stop, said foot and said lever being a unitary member, a tab on one of said side panels, said tab having a contact surface parallel to said planar mounting portion, said contact surface not co-planar with any surface on said planar mounting portion, said stop being defined by a surface on said lever abutting said contact surface.

3. A door latch comprising in combination:

a slide bolt movable from a first extended position to a second retracted position, a latch actuator in engagement with said slide bolt, said latch actuator including an axis and a distal end, said distal end being axially offset and extending parallel with respect to said axis, said latch actuator being rotatable about said axis from a first position wherein said slide bolt is in said extended position to a second position wherein said slide bolt is in said retracted position, a base plate having a planar mounting portion adapted for mounting against a planar surface of a door, and two opposing side panels, said axis of said latch actuator being perpendicular to said planar mounting portion, a lever pivotally mounted between said side panels, said lever having a foot for directly engaging said distal end of said latch actuator and for moving said latch actuator from said first position to said second position, biasing means for urging said foot away from said latch actuator, said lever having a stop contacting said base plate for preventing movement of said foot away from said latch actuator when said latch actuator is in said first position, said stop and said lever arm being a unitary member, a tab on one of said side panels, said tab having a contact surface parallel to said mounting portion, said contact surface not co-planar with any surface of said mounting portion, and said stop being defined by a surface on said lever for abutting said contact surface.

* * * * *